US009414722B2

(12) United States Patent
Matthews

(10) Patent No.: US 9,414,722 B2
(45) Date of Patent: Aug. 16, 2016

(54) FACIAL TISSUE WEIGHTED BOX SYSTEM

(71) Applicant: Donald Robert Matthews, Orem, UT (US)

(72) Inventor: Donald Robert Matthews, Orem, UT (US)

( * ) Notice: Subject to any disclaimer, the term of this patent is extended or adjusted under 35 U.S.C. 154(b) by 0 days.

(21) Appl. No.: 14/531,728

(22) Filed: Nov. 3, 2014

(65) Prior Publication Data

US 2016/0120378 A1 May 5, 2016

(51) Int. Cl.
*B65D 83/00* (2006.01)
*A47K 10/42* (2006.01)

(52) U.S. Cl.
CPC ..... *A47K 10/421* (2013.01); *B65D 83/00* (2013.01)

(58) Field of Classification Search
CPC ..... A47K 10/421
USPC ..... 221/45; 206/494; 24/303
See application file for complete search history.

(56) References Cited

U.S. PATENT DOCUMENTS 4,265,002 A * 5/1981 Hosken ..... A41F 1/002 24/303
4,913,312 A * 4/1990 Boutin ..... 221/45
5,139,167 A * 8/1992 McCarthy ..... 221/312 A
6,199,415 B1 * 3/2001 Markegard et al. ..... 70/209
7,275,656 B1 * 10/2007 Samadani ..... 221/45
7,494,098 B1 * 2/2009 Fulda ..... 248/206.5
8,464,377 B1 * 6/2013 Carson ..... A47G 9/02 24/303
9,010,562 B1 * 4/2015 Sparks ..... 220/475
2005/0263579 A1 * 12/2005 Rappley ..... 232/39
2010/0181311 A1 * 7/2010 Costecalde ..... B65D 5/2052 220/7
2011/0215110 A1 * 9/2011 Kadhum et al. ..... 221/45
2012/0283084 A1 * 11/2012 Cheich ..... A47K 10/421 493/464
2014/0182114 A1 * 7/2014 Stokes ..... F16B 5/0692 29/525.03
2015/0113843 A1 * 4/2015 Berry ..... A41F 1/002 40/600

OTHER PUBLICATIONS

Industrial Grade Pot Magnet, 10E725 Pot Magnet, 4-14/16Dia, Ceramic, Stl., Offered for Sale Sep. 24, 2013.*

* cited by examiner

*Primary Examiner* — Patrick Mackey
(74) *Attorney, Agent, or Firm* — Angus C. Fox, III

(57) ABSTRACT

A ballast system is provided for stabilizing a six-panel rectangular paperboard box containing a stack of inter-folded tissue sheets and having a opening in a top panel thereof for removal of individual tissue sheets. The ballast system includes at least two laminar backing plates fabricated from ferromagnetic material, the backing plates being positionable on an interior surface of said paperboard box, and at least two permanent magnets positionable on an exterior surface of said paperboard box, each permanent magnet securing itself and one backing plate to the paperboard box, with one of the six panels sandwiched therebetween. The box, the backing plates and the permanent magnets have a combined mass sufficient to prevent the box from being lifted from a surface on which it is resting when a tissue is pulled from the box through the opening as the number of folded tissues in the box approaches zero.

19 Claims, 2 Drawing Sheets

FACIAL TISSUE WEIGHTED BOX SYSTEM

CROSS-REFERENCE TO RELATED APPLICATIONS

This application has a priority date based on Provisional Patent Application No. 61/962,277, which was filed on Nov. 5, 2013.

FIELD OF THE INVENTION

The present invention relates, generally, to ballast systems used to stabilize boxes containing a quantity of consumable items and, more particularly, to a magnetically securable ballast system for boxes containing a quantity of folded tissue paper sheets.

BACKGROUND OF THE INVENTION

Facial tissues are generally packaged in a six-panel rectangular paperboard box containing a stack of inter-folded tissue sheets. Typically, the paperboard box has an opening in the center of the top paperboard panel that is sealed with a flexible polyethylene sheet membrane having a slit down the center that acts as a dust shield. Tissues are dispensed by pulling them, one at a time, through the slit in the membrane. Most people have experienced grabbing a tissue from a box of facial tissue, only to have the box lift from the surface on which it is resting, along with the tissue that is being removed from it. Likewise, most people have also experienced having to put one hand on the box to stabilize it and prevent it from lifting when a tissue is removed with the other hand. This typically happens when the box is only partly full and the weight of the box and the remaining enclosed tissues is insufficient to overcome the friction generated as a tissue is being pulled from the box through the slit in the sheet membrane.

Several decades ago, a product was advertised that was intended to overcome the problem described above. The tissue box sat on top of a two-part steel plate that was about the same size as the bottom of a standard tissue box. The plate was equipped with sharp projections that engaged the sides of the tissue box near the bottom thereof in order to hold the two-part steel plate in place.

The problem described above was never adequately resolved because the sharp projections that engaged the sides of the tissue box soon became disengaged from the box and the two-part plate fell off. In addition, the two-part plate had to be the same size as the box and would not accommodate a variety of box sizes and shapes as does my invention. Furthermore, the weight of the two-part plate was greater than it needed to be to stabilize the box, thereby making it difficult to carry the box from one location to another.

About the same time that the two-part plate product was on the market, there was another product intended to solve the same problem. This product consisted of a single rectangular sheet metal plate that was one inch longer and one inch wider than the top panel of a standard size of tissue box. The edges of the panel were downwardly bent at 90-degree angles so that the panel fitted snugly over the top of the box. There was also a cutout to accommodate the removal of tissues from the box opening. This product had problems similar to those of the two-part plate product: The weight of the device was excessive; the metal plate would only accommodate one size of tissue box; and the metal plate was not secured to the box.

BRIEF SUMMARY OF THE INVENTION

The present invention solves the problems of a six-panel rectangular paperboard tissue box lifting as tissues are pulled from it, through the slit in the dust shield, by providing a ballast system that provides mass and stability to the box. The ballast system includes at least two laminar backing plates fabricated from ferromagnetic material, the backing plates being insertable through the slit in the dust shield and positionable on an interior surface of the top panel of said paperboard box. The ballast system also includes at least two permanent magnets positionable on an exterior surface of the top panel of said paperboard box, each permanent magnet securing itself and one backing plate to the paperboard box, with the top panel sandwiched therebetween. The box, the backing plates and the permanent magnets have a combined mass that is sufficient to minimize the likelihood that the box will be lifted from a surface on which it is resting when a tissue is pulled from the box through the opening and the number of folded tissues in the box is approaching zero. The magnets and backing plates add mass to the tissue box, keeping it in place on a table and making it easier to pull tissues out of the box. The magnets and backing plates can be easily removed from an empty box and attached to a new box. The ballast system is compact, simple to use, lasts for years and fits onto any tissue box, regardless of size or shape.

DETAILED DESCRIPTION OF THE INVENTION

The present invention will now be described in detail, with reference to the attached drawing figures.

Figure 1:
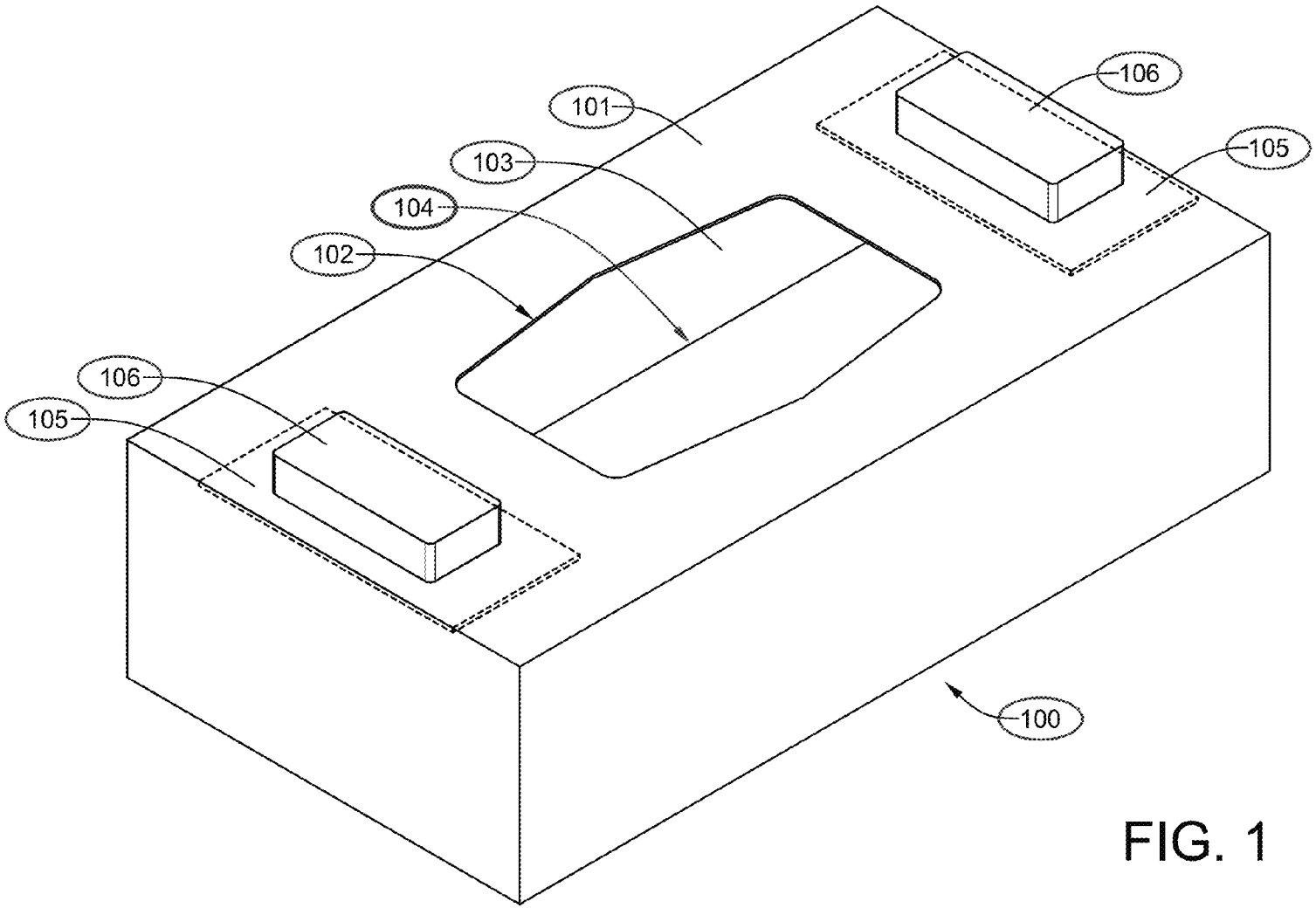
FIG. 1 is an isometric view of a standard, six-panel, rectangular tissue box equipped with a first configuration of the ballast system of the present invention.

Referring now to FIG. 1, a standard six-panel paperboard box 100, having a top panel 101 with a central opening 102 that is sealed with a flexible sheet membrane 103 having a central slit 104 through which tissues are dispensed, has been equipped with a first configuration of the ballast system of the present invention. The ballast system is designed to stabilize a paperboard box containing a stack of inter-folded tissue sheets. As each tissue is removed from the box through the slit 104, the interfolded configuration of the stacked tissues ensures that a portion the very next tissue below the one being removed will be pulled through the opening so that the protruding portion of that next tissue can be easily grasped and removed in succession. Friction generated by the tissues passing through the opening is the primary cause of a destabilizing upward force being applied to the box. As the number of folded tissues within the box approaches zero, and the friction generated as a tissue is pulled through the slit 104 becomes greater than the weight of the box and the remaining tissues, the box will have a tendency to lift from the surface on which it is resting when a tissue is removed through the slit 104.

Still referring to FIG. 1, the ballast system of the present invention counteracts that upward force by increasing the total weight of the box. The ballast system includes at least two laminar backing plates 105 fabricated from ferromagnetic material, which are positionable on an interior surface of the top panel 101, and at least two permanent magnets 106 positionable on an exterior surface of the top panel 101. Each permanent magnet 106 is used to secure itself and one backing plate 105 to the paperboard box, with the top panel 101 sandwiched therebetween. It will be noted that the top panel 101 has a rectangular peripheral edge 107, which includes a pair of longitudinal side edges 108A and 108B and a pair of transverse side edges 109A and 109B. For this first configuration of the backing plates 105 and the magnets 106, the backing plates 105 and the magnets 106 are positioned at opposite ends of the slit 104, in the middle of the top panel 101 between the opening 102 and one of the transverse side edges 109A or 109B. The box 100, the backing plates 105 and the permanent magnets 106 have a combined mass that is sufficient to prevent the box 100 from being lifted from a surface on which it is resting when a tissue is pulled from the box 100 through the slit 104 and opening 102, and the number of folded tissues in the box 100 is approaching zero. The ballast system is compact, simple to use, lasts almost indefinitely, and fits onto any tissue box, regardless of size or shape.

Figure 2:
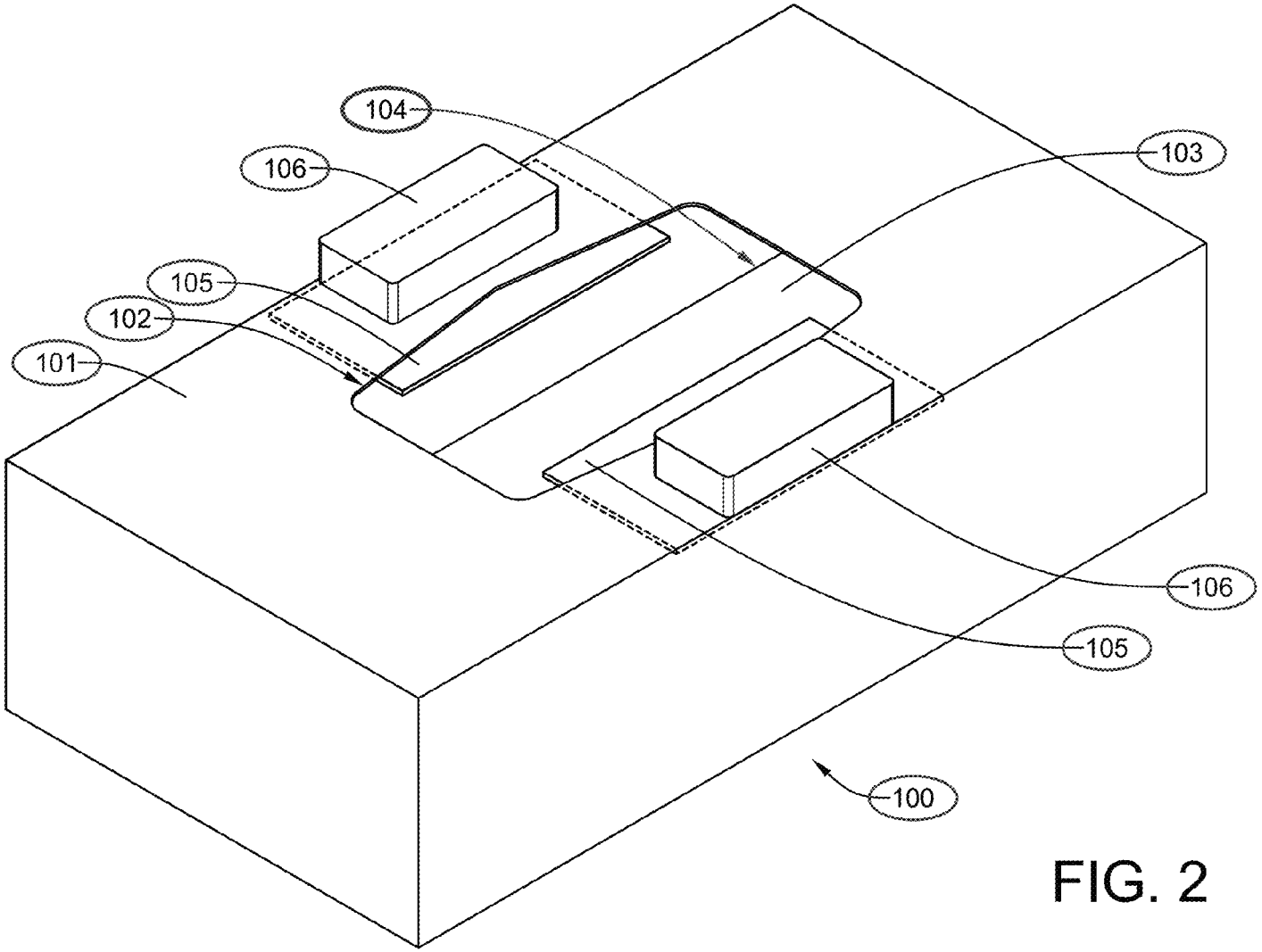
FIG. 2 is an isometric view of a standard, six-panel, rectangular tissue box equipped with a second configuration of the ballast system of the present invention.

Referring now to FIG. 2, the six-panel paperboard box 100 of FIG. 1 is shown again with the ballast components rearranged in a second configuration. While in FIG. 1, the backing plates 105 and the magnets 106 are positioned at opposite ends of the slit 104, in FIG. 2, they are positioned on opposite sides of the slit 104, in the middle of the top panel 101 between the opening 102 and one of the longitudinal side edges 108A or 108B.

Like most consumer products, and particularly those which are intended as impulse-buy items, this product almost certainly has associated with it a price elasticity of demand that is extremely negative. In other words, the higher the sales price, the smaller the quantity of items sold. In fact, the negative price elasticity of demand may actually be an exponential function, with sales dropping off at an increasing rate as the price is increased. Thus, manufacturing costs for such a product must be cut to a bare minimum so that a pricing structure conducive to high demand can be maintained.

The three common types of permanent magnets, listed in order of increasing magnetic field strength are: ferrite magnets (also referred to as ceramic magnets); aluminum-nickel-cobalt-iron alloy magnets (also referred to as alnico magnets); and rare-earth magnets, which are compounds of lanthanide elements and transition metals, such as iron, nickel and cobalt. Two types of rare-earth magnets are commonly available: neodymium magnets and samarium-cobalt ($SmCo_5$) magnets. Neodymium magnets, which are the least expensive and most powerful of the two, are made of an alloy of neodymium, iron and boron ($Nd_2Fe_{14}B$). They are frequently referred to as NIB magnets. Alnico magnets have up to 30 percent more magnetic energy than bonded ceramic magnets. NIB magnets have about 500 percent more magnetic energy than alnico magnets. Of the three types of commonly-available magnets, ferrite magnets are, by far, the least expensive. For that reason, they are used to implement the preferred embodiment of the invention. Though for any given weight, they are far less powerful than either alnico or NIB magnets, that characteristic is actually a positive attribute for this application, as we are looking to increase the mass of the tissue box.

When a facial tissue is removed from the box 100 that contains it, the weight of the box 100 and it's contents are usually sufficient to keep the box 100 in place. However, as it is emptied, insufficient weight remains to keep the box 100 in position. The box 100 frequently is lifted up with the tissues as they are pulled from the box 100. This is particularly annoying because it frequently takes two hands to remove a tissue, one to hold the box 100 down and the other to remove the tissue. In addition, the problem can sometimes occur with all the tissues from the first to the last when there is excessive resistance (friction) between the tissue and the opening 104.

This invention overcomes the above problem by adding weight to the box 100 in the form of two ferrite (ceramic) magnets 106 and two thin (16 gauge) steel plates 105. The two plates 105 are inserted through the slit 104 in the top 101 of the box 100. One is placed on each side of the opening 102 beneath the top panel 101 of the box 100 and on top of the enclosed stack of tissue (not shown). They can be placed anywhere on the interior surface of the top panel 101 of the box 100 so long as they do not cover the slit 104, however, it is most simple to position them either at the very ends of the top panel 101, as shown in FIG. 1, or on either side of the slit 104, as shown in FIG. 2. A permanent magnet 106 is then placed on the upper surface of the top panel 101, above backing plate 105. Because the magnets 106 are so powerful, and the paperboard from which the box 100 is made is relatively thin, the plates 105 and the magnets 106 cling to each other and stay firmly in position, with the top panel 101 sandwiched therebetween. The magnets 106 and the backing plates add the weight necessary to stabilize and hold the box 100 in position, thereby eliminating the annoyance of having to use two hands to remove tissues.

The enclosed drawing shows each of the magnets 106 as being about 4.75 cm long by 2.25 cm wide, by 1 cm thick. The preferred size of each of the steel backing plates 105 is about 7.62 cm long by 3.8 cm wide by 0.16 cm thick (16 gauge). However, other sizes, shapes, and thicknesses of both magnets 106 and backing plates 105 will also work as long as their combined weight is sufficient to hold the tissue box 100 in position.

Although only two configurations of a single embodiment of the new ballast system for tissue boxes have been shown and described, it will be obvious to those having ordinary skill in the art that changes and modifications may be made thereto without departing from the scope and the spirit of the invention as hereinafter claimed.

The invention claimed is:

1. In combination with a six-panel rectangular paperboard box containing a stack of interfolded tissue sheets, the box having an opening in a top panel thereof for removal of individual tissue sheets, a ballast system comprising:

at least two laminar backing plates fabricated from ferromagnetic material, each backing plate being positionable on an interior surface of the top panel between the opening and a side edge of the top panel; and at least two permanent magnets positionable on an exterior surface of the top panel, each permanent magnet securing itself and one backing plate to the top panel, with the top panel sandwiched between each magnet and its associated backing plate.

2. The combination of claim 1, wherein said box, said backing plates and said permanent magnets have a combined mass that is sufficient to minimize a likelihood of the box being lifted from a surface on which it is resting when a tissue is pulled from the box through the opening and the number of folded tissues in the box is approaching zero.

3. The combination of claim 1, wherein each backing plate is rectangularly shaped.

4. The combination of claim 1, wherein said at least two permanent magnets, along with their associated, magnetically-coupled backing plates, are positioned on opposite sides of the opening.

5. The combination of claim 4, wherein each of said at least two permanent magnets is positioned between a long side of the opening and a longitudinal side edge of the top panel.

6. The combination of claim 4, wherein each of said at least two permanent magnets is positioned between a short side of the opening and a transverse side edge of the top panel.

7. The combination of claim 1, wherein neither the laminar backing plates nor the permanent magnets are integral components of the paperboard box, and are, therefore, readily removable for storage or use on another like box.

8. A ballasted container comprising:

a six-panel rectangular paperboard box containing a stack of interfolded tissue sheets, the box having an opening in a top panel thereof;

at least two laminar backing plates fabricated from ferromagnetic material, each backing plate being positionable on an interior surface of the top panel between the opening and a side edge of the top panel; and at least two permanent magnets positionable on an exterior surface of the top panel, each permanent magnet securing itself and one backing plate to the top panel, with the top panel sandwiched between each magnet and its associated backing plate;

wherein neither the laminar backing plates nor the permanent magnets are integral components of the paperboard box and are, therefore, readily removable for storage or use on another like box.

9. The ballasted container of claim 8, wherein said box, said backing plates and said permanent magnets have a combined mass that is sufficient to minimize a likelihood of the box being lifted from a surface on which it is resting when a tissue is pulled from the box through the opening and the number of folded tissues in the box is approaching zero.

10. The ballasted container of claim 8, wherein each backing plate is rectangularly shaped.

11. The ballasted container of claim 8, wherein said at least two permanent magnets, along with their associated, magnetically-coupled backing plates, are positioned on opposite sides of the opening.

12. The ballasted container of claim 11, wherein each of said at least two permanent magnets is positioned between a long side of the opening and a longitudinal side edge of the top panel.

13. The ballasted container of claim 11, wherein each of said at least two permanent magnets is positioned between a short side of the opening and a transverse side edge of the top panel.

14. In combination with a six-panel rectangular paperboard box containing a stack of interfolded tissue sheets, the box having an opening in a top panel thereof through which tissue sheets may be removed, one at a time, from an interior of the box, a ballast system comprising:

at least two laminar backing plates fabricated from ferromagnetic material, each backing plate being positionable on an interior surface of the top panel between the opening and a side edge of the top panel; and at least two permanent magnets positionable on an exterior surface of the top panel, each permanent magnet securing itself and one backing plate to the top panel, with the top panel sandwiched between each magnet and its associated backing plate;

wherein neither the laminar backing plates nor the permanent magnets are integral components of the paperboard box and are, therefore, readily removable for storage or use on another like box.

15. The combination of claim 14, wherein said box, said backing plates and said permanent magnets have a combined mass that is sufficient to minimize a likelihood of the box from being lifted a surface on which it is resting when a tissue is pulled from the box through the opening and the number of folded tissues in the box is approaching zero.

16. The combination of claim 14, wherein each backing plate is rectangularly shaped.

17. The combination of claim 14, wherein said at least two permanent magnets, along with their associated, magnetically-coupled backing plates, are positioned on opposite sides of the opening.

18. The combination of claim 17, wherein each of said at least two permanent magnets is positioned between a long side of the opening and a longitudinal side edge of the top panel.

19. The combination of claim 17, wherein each of said at least two permanent magnets is positioned between a short side of the opening and a transverse side edge of the top panel.

* * * * *